US011377917B2

(12) United States Patent
Bushman et al.

(10) Patent No.: US 11,377,917 B2
(45) Date of Patent: Jul. 5, 2022

(54) STAGED ANNULAR RESTRICTION FOR MANAGED PRESSURE DRILLING

(71) Applicant: Schlumberger Technology Corporation, Sugar Land, TX (US)

(72) Inventors: Jerod Bushman, Tomball, TX (US); Shelby Wayne Carter, Sugar Land, TX (US); Henrix Soto, Houston, TX (US); Jeffrey Ham, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 31 days.

(21) Appl. No.: 16/469,641

(22) PCT Filed: Dec. 7, 2017

(86) PCT No.: PCT/US2017/065006

§ 371 (c)(1),
(2) Date: Jun. 14, 2019

(87) PCT Pub. No.: WO2018/118438

PCT Pub. Date: Jun. 28, 2018

(65) Prior Publication Data

US 2020/0080392 A1 Mar. 12, 2020

Related U.S. Application Data

(60) Provisional application No. 62/437,850, filed on Dec. 22, 2016.

(51) Int. Cl.
*E21B 21/08* (2006.01)
*E21B 21/10* (2006.01)
(Continued)

(52) U.S. Cl.
CPC ..... *E21B 21/08* (2013.01); *E21B 21/10* (2013.01); *E21B 47/06* (2013.01); *E21B 47/10* (2013.01)

(58) Field of Classification Search
CPC ..... E21B 21/08; E21B 21/10; E21B 21/106; E21B 47/06; E21B 47/10; E21B 34/025
See application file for complete search history.

(56) References Cited

U.S. PATENT DOCUMENTS 1,861,726 A 6/1932 Trout
1,930,361 A * 10/1933 Kilmer, Jr. ..... E21B 33/06 277/332

(Continued)

FOREIGN PATENT DOCUMENTS

EP 2208855 A2 7/2010
EP 2369128 A1 9/2011

(Continued)

OTHER PUBLICATIONS

International Search Report and Written Opinion for the equivalent International patent application PCT/US2017/065006 dated Mar. 15, 2018.

(Continued)

*Primary Examiner* — Daniel P Stephenson
(74) *Attorney, Agent, or Firm* — Kelly McKinney

(57) ABSTRACT

An apparatus includes a conduit forming part of a drilling fluid return path from a wellbore. The the conduit has at least one well outflow control in the conduit. The at least one well fluid outflow control has at least two annular flow restrictors each separately operable to close to a respective inner diameter.

20 Claims, 3 Drawing Sheets

(51) Int. Cl.
*E21B 47/06* (2012.01)
*E21B 47/10* (2012.01)

(56) References Cited

U.S. PATENT DOCUMENTS

| | | | | |
|---|---|---|---|---|
| 2,401,960 | A * | 6/1946 | Pranger | E21B 33/085 277/329 |
| 2,573,712 | A * | 11/1951 | Kallam | F16K 7/075 251/5 |
| 2,746,709 | A * | 5/1956 | Minor | E21B 33/06 277/324 |
| 3,885,769 | A * | 5/1975 | Morrison | F16K 7/07 251/5 |
| 4,399,869 | A * | 8/1983 | Bentley | E21B 33/08 166/311 |
| 5,273,108 | A * | 12/1993 | Piper | E21B 33/06 166/90.1 |
| 6,904,891 | B2 | 6/2005 | Tominaga et al. | |
| 6,904,981 | B2 | 6/2005 | van Riet | |
| 7,021,604 | B1 | 4/2006 | Werner et al. | |
| 7,395,878 | B2 | 7/2008 | Reitsma et al. | |
| 7,675,253 | B2 | 3/2010 | Dorel | |
| 7,984,770 | B2 | 7/2011 | Sehsah | |
| 9,163,473 | B2 | 10/2015 | Linde et al. | |
| 9,500,053 | B2 | 11/2016 | Leuchtenberg | |
| 2004/0069504 | A1 | 4/2004 | Krueger et al. | |
| 2005/0092523 | A1 | 5/2005 | McCaskill et al. | |
| 2007/0246263 | A1 | 4/2007 | Reitsma | |
| 2012/0132442 | A1 | 5/2012 | Head | |
| 2013/0140034 | A1 | 6/2013 | Ghasripoor et al. | |
| 2014/0216816 | A1 | 8/2014 | Lehr | |
| 2015/0167415 | A1 | 6/2015 | Leuchtenberg | |
| 2016/0201426 | A1 | 7/2016 | Cohen | |
| 2018/0038177 | A1 | 2/2018 | Leuchtenberg | |
| 2018/0363404 | A1 | 12/2018 | Faugstad | |
| 2020/0080392 | A1 * | 3/2020 | Bushman | E21B 47/06 |

FOREIGN PATENT DOCUMENTS

| | | | |
|---|---|---|---|
| GB | 2502626 | A | 12/2013 |
| WO | 0229200 | A1 | 4/2002 |
| WO | 2004/074627 | A1 | 9/2004 |
| WO | 2011/084153 | A1 | 7/2011 |
| WO | 2011119668 | A1 | 9/2011 |
| WO | 2015074932 | A2 | 5/2015 |
| WO | 2017035041 | A1 | 3/2017 |

OTHER PUBLICATIONS

International Preliminary Report on Patentability for the equivalent International patent application PCT/US2017/065006 dated Jul. 4, 2019.

Search and Examination Report issued in European Patent application 17884335.5 dated Jul. 2, 2020, 5 pages.

Office Action issued in Azerbaijan patent application a2019 0075 dated Nov. 12, 2020, 6 pages includes English Translation.

* cited by examiner

STAGED ANNULAR RESTRICTION FOR MANAGED PRESSURE DRILLING

This application claims the benefit of and priority to a US Provisional Application having Ser. No. 62/437,850, filed 22 Dec. 2016, which is incorporated by reference herein.

BACKGROUND

The disclosure relates generally to the field of "managed pressure" wellbore drilling. More specifically, the disclosure relates to managed pressure control apparatus and methods which do not require the use of a rotating control device ("RCD"), rotating blowout preventer or similar apparatus to restrict or close a wellbore annulus.

Managed pressure drilling uses well pressure control systems that control return flow of drilling fluid in a wellbore annulus to maintain a selected pressure or pressure profile in a wellbore. U.S. Pat. No. 6,904,981 issued to van Riet describes one such system for controlling wellbore pressure during the drilling of a wellbore through subterranean formations. The system described in the '981 patent includes a drill string extending into the wellbore. The drill string may include a bottom hole assembly ("BHA") including a drill bit, drill collars, sensors (which may be disposed in one or more of the drill collars), and a telemetry system capable of receiving and transmitting sensor data between the BHA and a control system disposed at the surface. Sensors disposed in the bottom hole assembly may include pressure and temperature sensors. The control system may comprise a telemetry system for receiving telemetry signals from the sensors and for transmitting commands and data to certain components in the BHA.

A drilling fluid ("mud") pump or pumps may selectively pump drilling fluid from a drilling fluid reservoir, through the drill string, out from the drill bit at the end of the drill string and into an annular space created as the drill string penetrates the subsurface formations. A fluid discharge conduit is in fluid communication with the annular space for discharging the drilling fluid to the reservoir to clean the drilling fluid for reuse. A fluid back pressure system is connected to the fluid discharge conduit. The fluid back pressure system may include a flow meter, a controllable orifice fluid choke, a back pressure pump and a fluid source coupled to the pump intake. The back pressure pump may be selectively activated to increase annular space drilling fluid pressure. Other examples may exclude the back pressure pump.

Systems such as those described in the van Riet '981 patent comprise a RCD or similar rotatable sealing element at a selected position, in some implementations at or near the upper end of the wellbore. The upper end of the wellbore may be a surface casing extending into the subsurface and cemented in place, or in the case of marine wellbore drilling, may comprise a conduit called a "riser" that extends from a wellhead disposed on the water bottom and extending to a drilling platform proximate the water surface. Further, in such systems as described in the van Riet '981 patent, a fluid discharge line from the upper end of the wellbore but below the RCD may comprise devices such as a controllable orifice choke such that drilling fluid returning from the wellbore may have its flow controllably restricted to provide a selected fluid pressure in the wellbore or a selected fluid pressure profile (i.e., fluid pressure with respect to depth in the wellbore).

FIG. 1 shows an example of a well drilling system 100 that uses a rotating control device (RCD) to close fluid discharge from a subsurface wellbore so that it is constrained to flow through a controllable orifice choke. Using the controllable orifice choke and measurements from certain sensors, explained below, a selected fluid pressure or fluid pressure profile may be maintained in the wellbore. While the present example embodiment and an embodiment according to the disclosure described with reference to FIG. 2, are described with reference to drilling a well below the bottom of the land surface, methods and apparatus according to the present disclosure may also be used with apparatus and methods for drilling into formations below the bottom of a body of water.

The well drilling system may make use of a managed pressure drilling (MPD) system during drilling of a wellbore to adjust the fluid pressure in a wellbore annulus to selected values during drilling. Operation and details of the MPD system may be substantially as described in U.S. Pat. No. 7,395,878 issued to Reitsma et al. and in U.S. Pat. No. 6,904,981 issued to van Riet.

The well drilling system 100 includes a hoisting device known as a drilling rig 102 that is used to support drilling a wellbore through subsurface rock formations such as shown at 104. Many of the components used on the drilling rig 102, such as a kelly (or top drive), power tongs, slips, draw works and other equipment are not shown for clarity of the illustration. A wellbore 106 is shown being drilled through the rock formations 104. A drill string 112 is suspended from the drilling rig 102 and extends into the wellbore 106, thereby forming an annular space (annulus) 115 between the wellbore 106 wall and the drill string 112, and/or between a casing 101 and the drill string 112. The drill string 112 is used to convey a drilling fluid 150 (shown in a storage tank or pit 136 to the bottom of the wellbore 106 and into the wellbore annulus 115.

The drill string 112 may support a bottom hole assembly (BHA) 113 proximate the lower end thereof that includes a drill bit 120, and may include a mud motor 118, a sensor package 119, a check valve (not shown) to prevent backflow of drilling fluid from the annulus 115 into the drill string 112. The sensor package 119 may be, for example, a measurement while drilling and logging while drilling (MWD/LWD) sensor system. In particular the BHA 113 may include a pressure transducer 116 to measure the pressure of the drilling fluid in the annulus at the depth of the pressure transducer 116. The BHA 113 shown in FIG. 1 may also include a telemetry transmitter 122 that can be used to transmit pressure measurements made by the transducer 116, MWD/LWD measurements as well as drilling information to be received at the surface. A data memory including a pressure data memory may be provided at a convenient place in the BHA 113 for temporary storage of measured pressure and other data (e.g., MWD/LWD data) before transmission of the data using the telemetry transmitter 122. The telemetry transmitter 122 may be, for example, a controllable valve that modulates flow of the drilling fluid through the drill string 112 to create pressure changes in the drilling fluid 150 that are detectable at the surface. The pressure changes may be coded to represent signals from the MWD/LWD system (sensor package 119) and the pressure transducer 116.

The drilling fluid 150 may be stored in a reservoir 136, which is shown in the form of a mud tank or pit. The reservoir 136 is in fluid communications with the intake of one or more mud pumps 138 that in operation pump the drilling fluid 150 through a conduit 140. A flow meter 152 may be provided in series with one or more mud pumps 138. The conduit 140 is connected to suitable pressure sealed swivels (not shown) coupled to the uppermost segment ("joint") of the drill string 112. During operation, the drilling fluid 150 is lifted from the reservoir 136 by the pumps 138, is pumped through the drill string 112 and the BHA 113 and exits the through nozzles or courses (not shown) in the drill bit 120, where it circulates the cuttings away from the bit 120 and returns them to the surface through the annulus 115. The drilling fluid 150 returns to the surface and passes through a drilling fluid discharge conduit 124 and in some embodiments through various surge tanks and telemetry receiver (e.g., a pressure sensor—not shown) to be returned, ultimately, to the reservoir 136.

A pressure isolating seal for the annulus 115 is provided in the form of a rotating control device (RCD) mounted above a blowout preventer ("BOP") 142. The drill string 112 passes through the BOP 142 and its associated RCD. When actuated, the RCD seals around the drill string 112, isolating the fluid pressure therebelow, but still enables drill string rotation and longitudinal movement. Alternatively a rotating BOP (not shown) may be used for essentially the same purpose. The pressure isolating seal forms a part of a back pressure system used to maintain a selected fluid pressure in the annulus 115.

As the drilling fluid returns to the surface it passes through a side outlet below the RCD to a back pressure system 131 configured to provide an adjustable back pressure on the drilling fluid in the annulus 115. The back pressure system 131 comprises a variable flow restriction device, in some embodiments in the form of a controllable orifice choke 130. It will be appreciated that there exist chokes designed to operate in an environment where the drilling fluid 150 contains substantial drill cuttings and other solids. The controllable orifice choke 130 may one type of a variable flow restriction device and is further capable of operating at variable pressures, flow rates and through multiple duty cycles.

The drilling fluid 150 exits the controllable orifice choke 130 and flows through a flow meter 126, which may then be directed through a optional degasser 1 and solids separation equipment 129. The degasser 1 and solids separation equipment 129 are designed to remove excess gas and other contaminants, including drill cuttings, from the returning drilling fluid 150. After passing through the degasser 1 and solids separation equipment 129, the drilling fluid 150 is returned to reservoir 136. In the present example, the drilling fluid reservoir 136 comprises a trip tank 2 in addition to the mud tank or pit 136. A trip tank may be used on a drilling rig to monitor drilling fluid gains and losses during movement of the drill string into and out of the wellbore 106 (known as "tripping operations").

Various valves 5, 125 and lines 4, 119, 119A, 119B may be provided to operate the back pressure system 131 if and as needed.

The flow meter 126 may be a mass-balance type, Coriolis-type or other high-resolution flow meter. A pressure sensor 147 may be provided in the drilling fluid discharge conduit 124 upstream of the variable flow restrictor (e.g., the controllable orifice choke 130). A second flow meter, similar to flow meter 126, may be placed upstream of the RCD in addition to the pressure sensor 147. The back pressure system 131 may comprise a control system 146 for monitoring measurements from the foregoing sensors (e.g., flow meters 126 and 152 and pressure transducer 147). The control system 146 may provide operating signals to selectively control To enable data relevant for the annulus pressure, and providing control signals to at least a back pressure system 131 and in some embodiments to the mud pumps 138.

The back pressure system 131 may comprise the controllable orifice choke 130, flow meter 126 and a secondary pump 128. Signals from the above described sensors may be conducted to a control unit 146. Control signals from the control unit 146 may be conducted to the mud pump(s) 138, the secondary pump 128 and the controllable orifice choke 130 During operation of the drilling system, if the drilling fluid pump 138 is operating, the back pressure system 131 may provide a selected pressure in the annulus 115 by operating the controllable orifice choke 130 to restrict the flow of drilling fluid 150 leaving the annulus 115. During times when the drilling fluid pump 138 is not operating, the secondary pump 128 may provide drilling fluid under pressure to the annulus 115 to maintain the selected fluid pressure.

In some embodiments, a selected fluid pressure may be applied to the annulus 115 to maintain the desired annulus in the wellbore 106 by obtaining, at selected times, measurements related to the existing pressure of the drilling fluid in the annulus 115 in the vicinity of the BHA 113 using the pressure transudcer 116 or similar pressure sensor. Such pressure measurement may be referred to as the bottom hole pressure (BHP). Differences between the determined BHP and the desired BHP may be used for determining a set-point back pressure. The set point back pressure is used for controlling the back pressure system 131 in order to establish a back pressure close to the set-point back pressure. Information concerning the fluid pressure in the annulus 115 proximate the BHA 113 may be determined using an hydraulic model and measurements of drilling fluid pressure as it is pumped into the drill string and the rate at which the drilling fluid is pumped into the drill string (e.g., using a flow meter or a "stroke counter" typically provided with piston type mud pumps). The BHP information thus obtained may be periodically checked and/or calibrated using measurements made by the pressure transducer 116.

In other embodiments, an injection fluid supply 143 which may comprise a storage tank and one or more injection pumps (not shown separately) may use a pressure measurement generated by an injection fluid pressure sensor anywhere in the injection fluid supply passage, e.g., at 156, may be used to provide an input signal for controlling the back pressure system 131, and thereby for monitoring the drilling fluid pressure in the wellbore annulus 115.

The pressure signal may, if so desired, be compensated for the density of the injection fluid column and/or for the dynamic pressure loss that may be generated in the injection fluid between the injection fluid pressure sensor in the injection fluid supply passage and where the injection into the drilling fluid return passage takes place, for instance, in order to obtain an exact value of the injection pressure in the drilling fluid return passage at the depth where the injection fluid is injected into the drilling fluid gap.

The described existing MPD system is effective, however there are limitations inherent to the use of RCDs in controlling fluid leaving a wellbore. It is desirable to provide control of fluid pressure in a wellbore (i.e., annulus) without the need to use RCDs or similar rotating pressure control devices at the upper end of the well.

DETAILED DESCRIPTION

Figure 1:
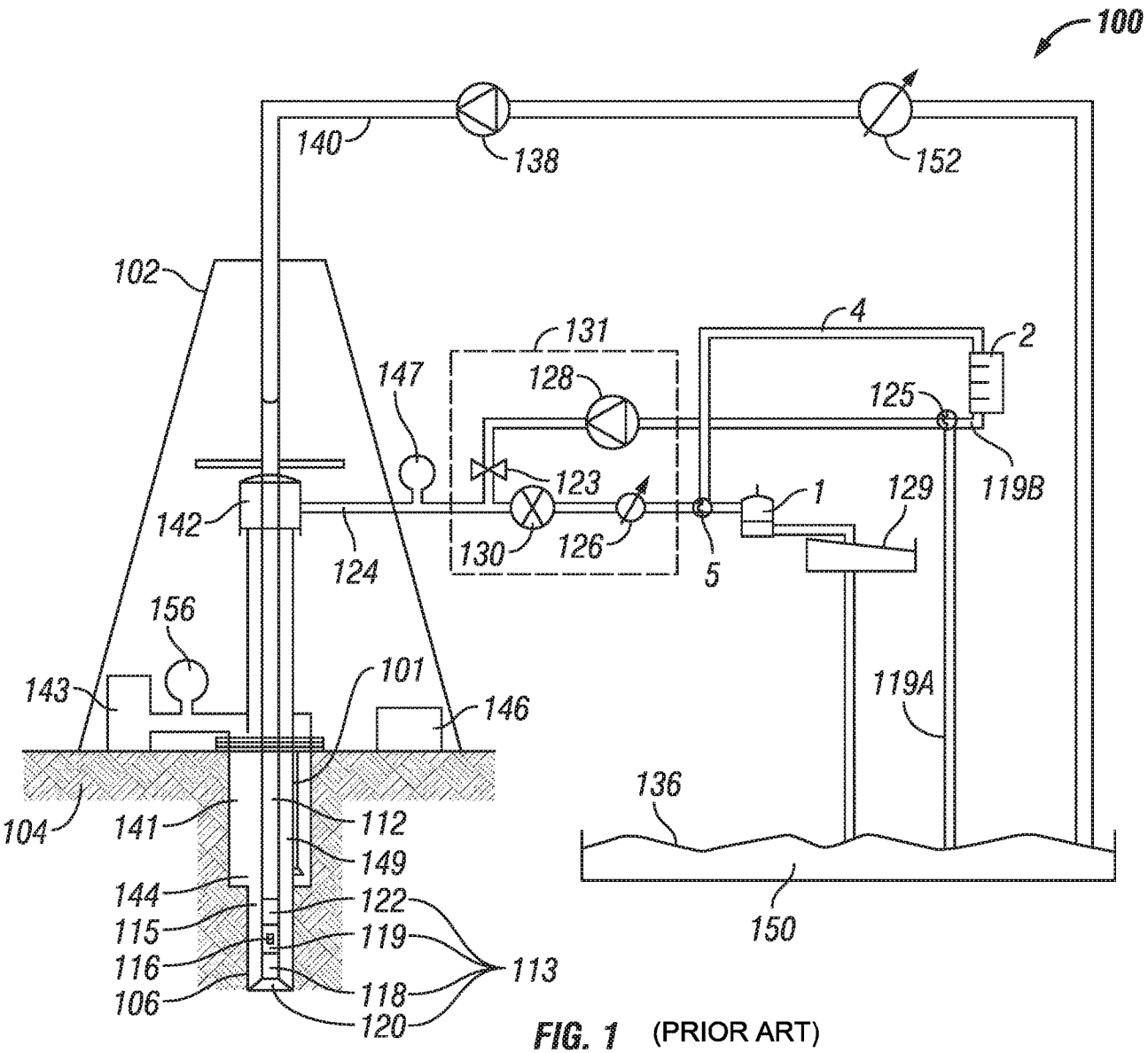
FIG. 1 (PRIOR ART)
FIG. 1 shows an example embodiment of a drilling system including a well pressure control apparatus.
Figure 2:
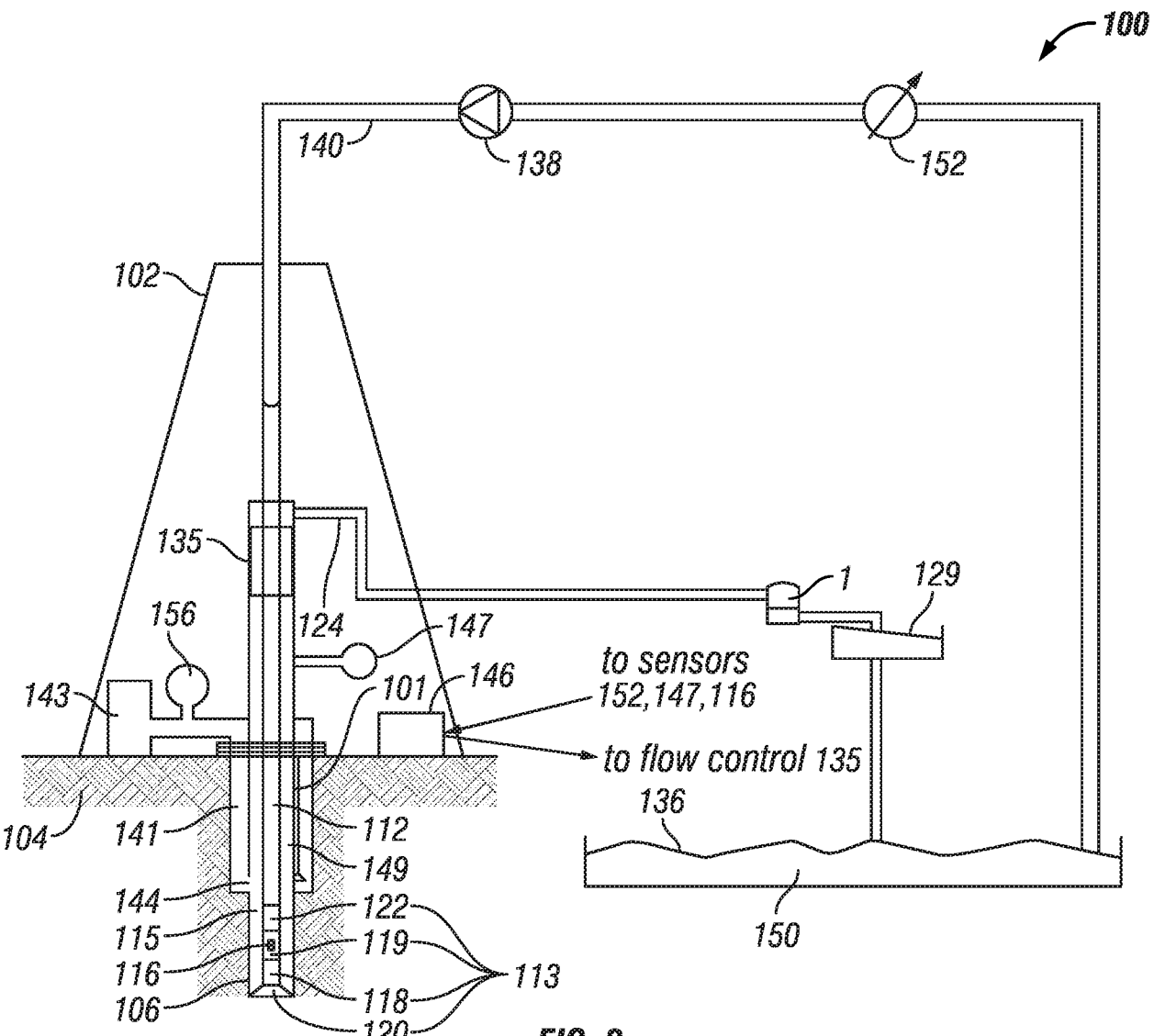
FIG. 2 shows an example embodiment of a drilling system including a well outflow control according to the present disclosure used in connection a well pressure control apparatus.

An example embodiment of a well drilling system 100 that may be used with a well fluid discharge control may be better understood with reference to FIG. 2. The well drilling system 100 may comprise many of the same components described with reference to the well drilling system shown in FIG. 1 and described above.

Components of the example embodiment of the well drilling system in FIG. 2 may omit the backpressure system 131 and the components therein, including, for example the variable orifice choke (130 in FIG. 1), the secondary pump 128, and external to the backpressure system 131, valves 5, 125 lines 4, 119A and 119B. The RCD at the upper end of the BOP 142 may also be omitted. Flow out of the annulus 115 may be controlled by a well outflow control 135 disposed in the well casing 101, above a BOP stack (not shown in FIG. 2). The well casing 101 may comprise a fluid discharge line 124 connected to the wellbore 106 above the well outflow control 135, such that the fluid actually discharged from the wellbore 106 may be at atmospheric pressure, and the wellbore 106 may not need a rotating sealing element such as a RCD (as shown in FIG. 1).

The well outflow control 135 will be further explained below with reference to FIG. 3. In the present example embodiment of a well drilling system, pressure in the annulus 115 may be maintained by communicating to the control system 146 signals from the flow meter 152, pressure transducer 116, pressure sensor 147 and in some embodiments a second flow meter 126 disposed in the fluid discharge line 124. Control signals from the control system 146 may operate the well outflow control 135 and the mud pump(s) 138 to maintain a selected fluid pressure in the annulus 115. The selected fluid pressure may be calculated substantially as explained above with reference to FIG. 1 and in a manner similar to operation of a controllable choke as disclosed in U.S. Pat. No. 6,904,891 issued to van Riet, incorporated herein by reference in its entirety. When the mud pump(s) are switched off, such as during adding a segment of dill pipe to the drill string 112 or removing a segment therefrom, pressure in the annulus 115 may be maintained using the fluid injection system comprising the injection fluid supply 143 which may comprise a storage tank and one or more injection pumps (not shown separately) and the pressure measurement generated by the injection fluid pressure sensor disposed anywhere in the injection fluid supply passage, e.g., at 156.

Figure 3:
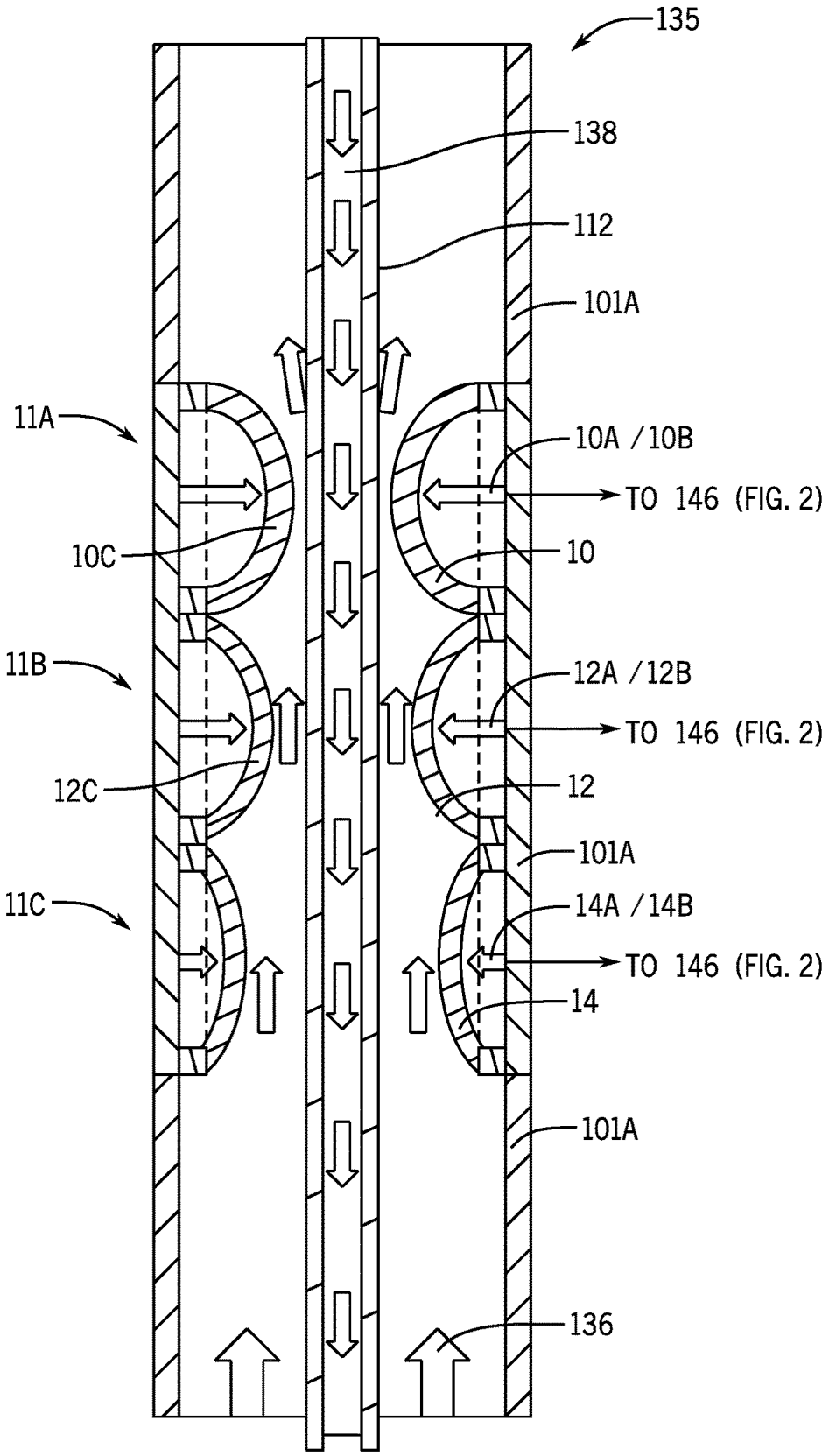
FIG. 3 shows a detailed view of one example embodiment of a well outflow control.

One example embodiment of a well outflow control is shown schematically in FIG. 3. The well outflow control 135 may comprise a housing 101A, which may be a segment of well casing, e.g., shown at 101 in FIG. 2 or a segment of drilling riser (not shown) for marine drilling applications. The present example embodiment of the well outflow control 135 may include a plurality of, in the present example embodiment three, inwardly expandable, annular flow restrictors 11A, 11B, 11C. The annular flow restrictors 11A, 11B, 11C may be coupled to or affixed to an interior of the housing 101A at selected longitudinal positions along the interior of the housing 101A. In some embodiments more or fewer annular flow restrictors may be used. A minimum number of the annular flow restrictors 11A, 11B 11C may be two. In the present example embodiment, the annular flow restrictors 11A, 11B, 11C may each comprise a controllable inner diameter restrictor element, shown at 10, 12 and 14, respectively. In some embodiments, the restrictor elements 10, 12, 14 may each comprise an inflatable elastomer bladder.

Each annular flow restrictor 11A, 11B, 11C may comprise a respective actuator and sensor, shown at 10A/10B, 12A/12B and 14A/14B, as a single element in FIG. 3 for clarity of the drawing. In one embodiment actuator 10A, 12A, may comprise a line (not shown) coupled to the outlet of a pump (e.g., part of 143 in FIG. 2)), whereby fluid pumped into a space within the restrictor element 10, 12, 14 causes the restrictor element 10, 12, 14 to inflate and correspondingly reduce the cross-sectional area of a space between the exterior of the drill string 112 and the inner diameter of each inflated restrictor element 10, 12, 14. In the present example embodiment, an amount of inflation may be determined from measurements made by the respective sensors 10B, 12B, 14B. In some embodiments, the sensors 10B, 12B, 14B may comprise pressure sensors, whereby an amount of closure of each restrictor element may be inferred from the pressure measured by each sensor 10B, 12B, 14B. In some embodiments the sensors 10B, 12B, 14B may comprise linear position sensors, for example, linear variable differential transformers (LVDTs). In some embodiments, the actuators 10A, 12A, 14A may comprise linear actuators. See, for example, U.S. Pat. No. 7,675,253 issued to Dorel. In some embodiments, one or more of the restrictor elements 10, 12, 14 may comprise an "iris" type valve. See, for example, U.S. Pat. No. 7,021,604 issued to Werner et al.

Regardless of the type of actuator used, functionally, each actuator 10A, 12A, 14A when operated causes the respective restrictor element 10, 12, 14 to close to a selected inner diameter. In the present embodiment, the lowermost restrictor element 14 is closed to the largest inner diameter. The middle restrictor element 12 may be closed to an inner diameter intermediate to the closed inner diameter of the lowermost restrictor element 14 and the uppermost restrictor element 10. The uppermost restrictor element 10 thus may be closed to the smallest inner diameter. Each sensor 10B, 12B, 14C is in signal communication with the control unit (146 in FIG. 2) such that the amount by which each annular flow restrictor 11A, 11B, 11C is closed may be determined and used by the control unit (146 in FIG. 2) to cause operation of each actuator 10A, 12A, 14A to close the respective annular flow restrictor 11A, 11B, 11C to an amount such that fluid in the wellbore (112 in FIG. 2) is maintained at a selected pressure, or provides a selected pressure profile along the wellbore (112 in FIG. 2).

Opening and closing the annular flow restrictors 11A, 11B, 11C may be controlled in a manner similar to operating a variable orifice choke as explained in the Background section herein. In some embodiments, the amount of closure of each of the annular flow restrictors 11A, 11B, 11C in the aggregate may enable maintain the wellbore pressure at a selected set point pressure, for example, as described in the van Riet '891 patent referred to above. Using multiple annular flow restrictors 11A, 11B, 11C closed to successively smaller inner diameters along the direction of returning drilling fluid 138 moving upwardly through the housing 101A reduces the pressure of the returning drilling fluid 138 in stages in order to reduce drill string wear resulting from increased velocity of the drilling fluid 138. The increase in velocity is related to the reduction in diameter of the annular space between the outside of the drill string 112 and the inner surface of each annular flow restrictor 11A, 11B, 11C.

The present example embodiment provides that the restrictor elements 10, 12, 14 when fully inflated (or closed to a smallest inner diameter) do not actually contact the drill string 112. There is, however, the possibility of incidental wear if the drill string 112 is off center. The restrictor elements 10, 12, 14 in some embodiments may comprise wear plates 10C, 12C, 14C formed into or affixed to the interior surface of each restrictor element 10, 12, 14, respectively to reduce wear by incidental contact with the drill string 112. Such wear plates 10C, 12C, 14C may be made from steel or other wear resistant material.

A well fluid outflow control according to the various aspects of the present disclosure may enable performing managed pressure drilling (MPD) without the need to use a rotating control device or similar rotating sealing element. Such capability may reduce the time and expense of repair and maintenance of rotating control devices.

While the present disclosure describes a limited number of embodiments, those skilled in the art, having benefit of this disclosure, will appreciate that other embodiments can be devised which do not depart from the scope of what has been disclosed herein. Accordingly, the scope of the disclosure should be limited only by the attached claims.

What is claimed is:

1. A system, comprising:

a drill string extending into a wellbore drilled through subsurface formations;

a pump having an inlet in fluid communication with a supply of drilling fluid, the pump having an outlet in fluid communication with an interior of the drill string;

a conduit extending from a first position in the wellbore to a second position proximate a surface end of the wellbore, wherein the pumped drilling fluid is configured to be returned upwardly through an annular space between an exterior of the drill string and an interior of the conduit;

at least one well fluid outflow control comprising a housing disposed along the conduit and at least two annular flow restrictors disposed at distinct axial positions within the housing; and a control system configured to generate control signals to cause the at least two annular flow restrictors to close to provide successively smaller inner diameters in a direction of the drilling fluid moving upwardly through the annular space.

2. The system of claim 1 wherein each of the at least two annular flow restrictors comprises an inflatable restrictor element.

3. The system of claim 2 wherein each inflatable restrictor element comprises a linear position sensor arranged to measure an amount of closure of the respective inflatable restrictor element.

4. The system of claim 2 wherein each inflatable restrictor element comprises a pressure sensor operable to measure a fluid pressure inside the respective inflatable restrictor element.

5. The system of claim 2 wherein each inflatable restrictor element comprises a wear plate on an interior surface thereof.

6. The system of claim 1 wherein each of the at least two annular flow restrictors comprises an iris valve.

7. The system of claim 1 wherein each of the at least two annular flow restrictors comprises a linear actuator operable to close a restrictor element on the respective annular flow restrictor.

8. The system of claim 1 further comprising a pressure sensor arranged to measure pressure of the drilling fluid in the annular space between the drill string and the conduit at a position below the at least one well fluid outflow control.

9. The system of claim 1 further comprising at least one flow meter arranged to measure a first rate of flow of the drilling fluid into the drill string from the pump, and at least one flow meter arranged to measure a second rate of flow of the drilling fluid out of the conduit.

10. The system of claim 1 further comprising a pressure sensor arranged to measure pressure of the drilling fluid at an inlet to the interior of the drill string.

11. The system of claim 1 wherein the conduit comprises a casing in the wellbore.

12. A method, comprising:

pumping drilling fluid through a drill string extended into a wellbore drilled through subsurface formations;

returning the pumped drilling fluid upwardly through an annular space between an exterior of the drill string and an interior of a conduit disposed to a selected depth in the wellbore; and selectively restricting outflow of fluid from the interior of the conduit by operating at least one well fluid outflow control comprising a housing disposed along the conduit and at least two annular flow restrictors disposed at distinct axial positions within the housing, wherein operating the at least one well fluid outflow control comprises generating control signals to instruct the at least two annular flow restrictors to close to provide successively smaller inner diameters in a direction of the drilling fluid moving upwardly through the annular space.

13. The method of claim 12 further comprising measuring a pressure of the drilling fluid in the conduit below the at least one well fluid outflow control, and automatically operating the at least one well fluid outflow control to close the at least two annular flow restrictors to the successively smaller inner diameters to maintain a selected pressure in the wellbore.

14. The method of claim 12 further comprising measuring a pressure of the drilling fluid entering an interior of the drill string and measuring a flow rate of the drilling fluid entering the interior of the drill string or a flow rate of the drilling fluid exiting the conduit, and automatically operating the at least one well fluid outflow control to close the at least two annular flow restrictors to the successively smaller inner diameters to maintain a selected measured pressure and measured flow rate.

15. An apparatus, comprising:

a conduit forming part of a drilling fluid return path from a wellbore, the conduit comprising at least one well outflow control in the conduit;

wherein the at least one well fluid outflow control comprises at least two annular flow restrictors disposed at distinct axial positions in the conduit and that are separately operable to close to provide successively smaller inner diameters in a direction of the drilling fluid moving upwardly in the return path from the wellbore.

16. The apparatus of claim 15 wherein each of the at least two annular flow restrictors comprises an inflatable restrictor element.

17. The apparatus of claim 16 wherein each inflatable restrictor element comprises a sensor arranged to measure an amount of closure of the respective inflatable restrictor element.

18. The apparatus of claim 16 wherein each inflatable restrictor element comprises a pressure sensor operable to measure a fluid pressure inside the respective inflatable restrictor element.

19. The apparatus of claim 15, comprising a control system configured to generate control signals to instruct the at least two annular flow restrictors to close to provide the successively smaller inner diameters.

20. The apparatus of claim 15, wherein none of the at least two annular flow restrictors are configured to form an annular seal about an exterior of a drill string extending through the conduit while the at least two annular flow restrictors are closed to provide the successively smaller inner diameters.

* * * * *